US006250895B1

(12) United States Patent
Kawahara et al.

(10) Patent No.: US 6,250,895 B1
(45) Date of Patent: Jun. 26, 2001

(54) LINEAR COMPRESSOR

(75) Inventors: Sadao Kawahara; Teruyuki Akazawa, both of Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/370,166

(22) Filed: Aug. 9, 1999

(30) Foreign Application Priority Data

Aug. 11, 1998 (JP) ..... 10-239499

(51) Int. Cl.[7] ..... F04B 17/00
(52) U.S. Cl. ..... 417/363
(58) Field of Search ..... 417/312, 366, 417/416, 417, 902; 181/403; 310/13, 14, 23

(56) References Cited

U.S. PATENT DOCUMENTS

| | | | | |
|---|---|---|---|---|
| 3,490,684 | * | 1/1970 | Rietveld | 230/55 |
| 3,635,593 | * | 1/1972 | Moret | 417/417 |
| 3,910,729 | * | 10/1975 | Jepsen et al. | 417/417 |
| 4,644,851 | | 2/1987 | Young . | |
| 5,146,124 | | 9/1992 | Higham et al. . | |
| 5,525,845 | | 6/1996 | Beale et al. . | |
| 5,704,771 | * | 1/1998 | Fujisawa et al. | 417/417 |
| 5,772,410 | * | 6/1998 | Chang | 417/363 |
| 5,944,302 | * | 8/1999 | Loc | 267/180 |

FOREIGN PATENT DOCUMENTS 1 550 579 12/1968 (FR) .
1.550.579 12/1968 (FR) .

OTHER PUBLICATIONS

Copy of European Search Report dated Sep. 20, 2000.

* cited by examiner

*Primary Examiner*—Timothy S. Thorpe
*Assistant Examiner*—William H. Rodriguez
(74) *Attorney, Agent, or Firm*—Armstrong, Westerman, Hattori, McLeland and Naughton, LLP

(57) ABSTRACT

A linear compressor comprises a cylinder 10, a piston 20, a linear motor comprising a movable member 40 as well as a stationary member 50, a piston body 28, a discharge mechanism 60, a spring mechanism 70, a vessel 80, a supporting mechanism 90 and the like. A cylindrical holding member 41 is contact with a flange 24 connected to the piston and supported concentrically with the piston 20. A permanent magnet 42 is sandwiched between the cylindrical holding member 41 and a cylindrical body 43. Cylindrical inner yoke 51 and outer yoke 52 of the stationary member 50 are fixed to the cylinder 10, and held concentrically with the piston 20. With the above structure, the movable 40 is smoothly moved together with the piston 20, and a fine gap between the movable member 40 and the stationary member 50 is always maintained stationary. Further, since the linear motor is in contact with the piston 20, the overall length of the linear compressor is shortened, and the linear compressor is reduced in size. Therefore, it is possible to easily mount the movable member to the piston with high precision, and it is possible to easily mount the permanent magnet of the movable member with high precision.

10 Claims, 5 Drawing Sheets

LINEAR COMPRESSOR

TECHNICAL FIELD

The present invention relates to a linear compressor to which little load in a direction perpendicular to a direction of reciprocating motion of a piston is applied, and more particularly, to a linear compressor in which a linear motor is disposed around an outer periphery of a piston, and it is possible to easily mount the linear motor with high precision.

BACKGROUND TECHNIQUE

It is said that HCFC-based refrigerant, such as R22, which is utilized in an air conditioner and is a stable compound, destroys the ozone layer. In recent years, HFC-based refrigerants are utilized as alternative refrigerants of HCFC, but these HFC-based refrigerants have the nature for facilitating global warming. Therefore, there is a tendency to start employing HC-based refrigerants which do not destroy the ozone layer or largely affect global warming. However, since the HC-based refrigerants are flammable, it is necessary to prevent explosion or ignition so as to ensure safety, and it is required to reduce the amount of use of the refrigerant to the utmost. On the other hand, HC-based refrigerants do not have lubricity and are prone to be solved into lubricants. Therefore, when HC-based refrigerants are used, the use of an oil free or oil poor compressor is required, and a linear compressor in which little load is applied in a direction perpendicular to an axis of a piston.

Here, a linear compressor in which a linear motor is disposed around an outer periphery of a piston is disclosed in Japanese Patent Application Laid-open No. H8-144954, Japanese Patent Application Laid-open No.H4-34760 and U.S. Pat. No. 5,525,845.

However, in the above prior art, there is no suggestion to easily mount a movable member of a linear motor to a piston with high precision.

It is described in Japanese Patent Application Laid-open No.H4-34760 that a piston is provided at its end with a flange, and the flange is concentrically provided with a cylindrical bobbin. However, there is no description as to how the bobbin is provided concentrically. Further, as shown in FIG. 1, of the publication the flange is provided merely for mounting the bobbin by a screw. Therefore, the mounting precision of the bobbin to the piston can not be enhanced by this prior art.

Therefore, it is an object of the present invention to provide a linear compressor in which it is possible to easily mount a movable member of a linear motor to a piston with high precision.

Further, when the movable member is a permanent magnet, it is another object of the invention to provide a linear compressor in which it is possible to easily mount this permanent magnet with high precision.

DISCLOSURE OF THE INVENTION

According to a first aspect of the present invention, there is provided a linear compressor, comprising: a cylinder supported in a vessel by a supporting mechanism; a piston A concentric with the cylinder and movably supported along an axial direction of the cylinder, and a linear motor for forming a magnetic path by a movable member fixed to the piston and a stationary member fixed to the cylinder to generate a thrust force; the linear motor being disposed around an outer periphery of the piston, wherein the piston is provided with a flange having a side surface formed concentrically with an axis of the piston, the movable member is held by a cylindrical holding member, and the cylindrical holding member is fixed such that the cylindrical holding member is in contact with the side surface of the flange.

With this feature, since the side surface is concentric with the piston, the cylindrical holding member can also be provided concentrically with the piston. Since the cylindrical holding member holds the movable member, the movable member is disposed concentrically with the piston, and can be positioned precisely. Further, the mounting operation of the movable member is also easy. Furthermore, the overall length of the movable member and the piston constituting the moving member can be shortened, as compared with a structure in which the piston and the linear motor are juxtaposed in the moving direction. Even if the piston is slightly inclined, little influence is exerted on the gap of the movable member, which contributes to enhancement of efficiency of the compressor.

According to a second aspect of the present invention, there is provided a linear compressor, comprising: a cylinder supported in a vessel by a supporting mechanism; a piston concentric with the cylinder and movably supported along an axial direction of the cylinder, and a linear motor for forming a magnetic path by a movable member fixed to the piston and a stationary member fixed to the cylinder to generate a thrust force; the linear motor being disposed around an outer periphery of the piston, wherein the piston is provided with a flange which has a side surface formed concentrically with an axial of the piston and an end surface formed perpendicular to the axis of the piston, the movable member is held by a cylindrical holding member, and the cylindrical holding member is fixed such that the cylindrical holding member is in contact with the side surface and the end surface of the flange.

With this feature, the cylindrical holding member is disposed concentrically with the piston, and the movable member held by the cylindrical holding member is disposed concentrically with the piston and positioned precisely. Further, the mounting operation of the movable member is also easy. Furthermore, the overall length of the movable member and the piston constituting the moving member can be shortened as compared with a structure in which the piston and the linear motor are juxtaposed in the moving direction, even if the piston is slightly inclined, little influence is exerted on the gap of the movable member, which contributes to enhancement of efficiency of the compressor.

According to a third aspect, in the first or second aspect, the cylinder is provided with a flange portion, the flange portion is formed concentrically with an axis of the cylinder, the stationary member constituting the linear motor is formed cylindrically, and the stationary member is fixed to the flange portion.

With this feature, the stationary member can be disposed concentrically with the cylinder, the positional relation between the movable member and the stationary member disposed concentrically with the piston can be maintained precisely, and the gap between the movable member and the stationary member can be reduced. Therefore, the efficiency of the compressor can be enhanced.

According to a fourth aspect, in the third aspect, the movable member is a permanent magnet, and the stationary member is an outer yoke and a coil.

With this feature, since the stationary member is concentrically fixed to the cylinder side and the permanent magnet is concentrically held on the piston side, the positional precision therebetween is enhanced. Further, since the coil is the stationary member, it is easy to carry out wiring for energizing the coil.

According to a fifth aspect, in the first or second aspect, an outer peripheral surface of the cylinder is formed concentrically with an axis of the cylinder, the stationary member constituting the linear motor is formed cylindrically, and the stationary member is held by the cylinder such that the stationary member is in contact with the outer peripheral surface.

With this feature, the movable member is concentric with the stationary member, and it is possible to easily reduce the size and the gap, and to enhance the efficiency of the compressor.

According to a sixth aspect, in the fifth aspect, the movable member is a permanent magnet, and the stationary member in an inner yoke.

With this feature, both the permanent magnet and the inner yoke can be disposed concentrically with each other, and since the inner yoke is not disposed at the movable side, the weight of the movable member side can be reduced.

According to a seventh aspect, there is provided a linear compressor, comprising: a cylinder supported in a vessel by a supporting mechanism; a piston concentric with the cylinder and movably supported along an axial direction of the cylinder, and a linear motor for forming a magnetic path by a permanent magnet fixed to the piston and a coil fixed to the cylinder to generate a thrust force; the linear motor being disposed around an outer periphery of the piston, wherein the permanent magnet is sandwiched and fixed between a cylindrical holding member fixed to the piston and a cylindrical body concentric with the cylindrical holding member.

With this feature, it is possible to reduce the gap between the permanent magnet and the stationary member, and the mounting operation is facilitated, and the compressor can be used normally for a long term. That is, the interior of the compressor is not only brought into high temperature, but also into contact with refrigerant of lubricant. Therefore, if adhesive is used for fixing the permanent magnet, there is a problem that adhesive power is lowered, and it is difficult to maintain the precision. Further, there are problems that it is difficult to fix the permanent magnet using a screw, and the operation time is increased. By sandwiching the magnet between the cylindrical holding member and the cylindrical body, the above problems are overcome.

According to an eighth aspect, in the seventh aspect, the permanent magnet is provided around an outer periphery of the cylindrical holding member, and the cylindrical body is provided around an outer periphery of the permanent magnet.

With this feature, it is possible to easily fit the permanent magnet to the cylindrical holding member.

According to a ninth aspect, in the seventh aspect, the cylindrical holding member or the cylindrical body is made of metal material, and the cylindrical holding member or the cylindrical body is provided with a slit.

With this feature, it is possible to secure sufficient mechanical strength for the linear compressor. Since the slit is provided, it is possible to reduce the eddy current to prevent the performance from being lowered.

DESCRIPTION OF PREFERRED EMBODIMENTS OF THE INVENTION

Figure 1:
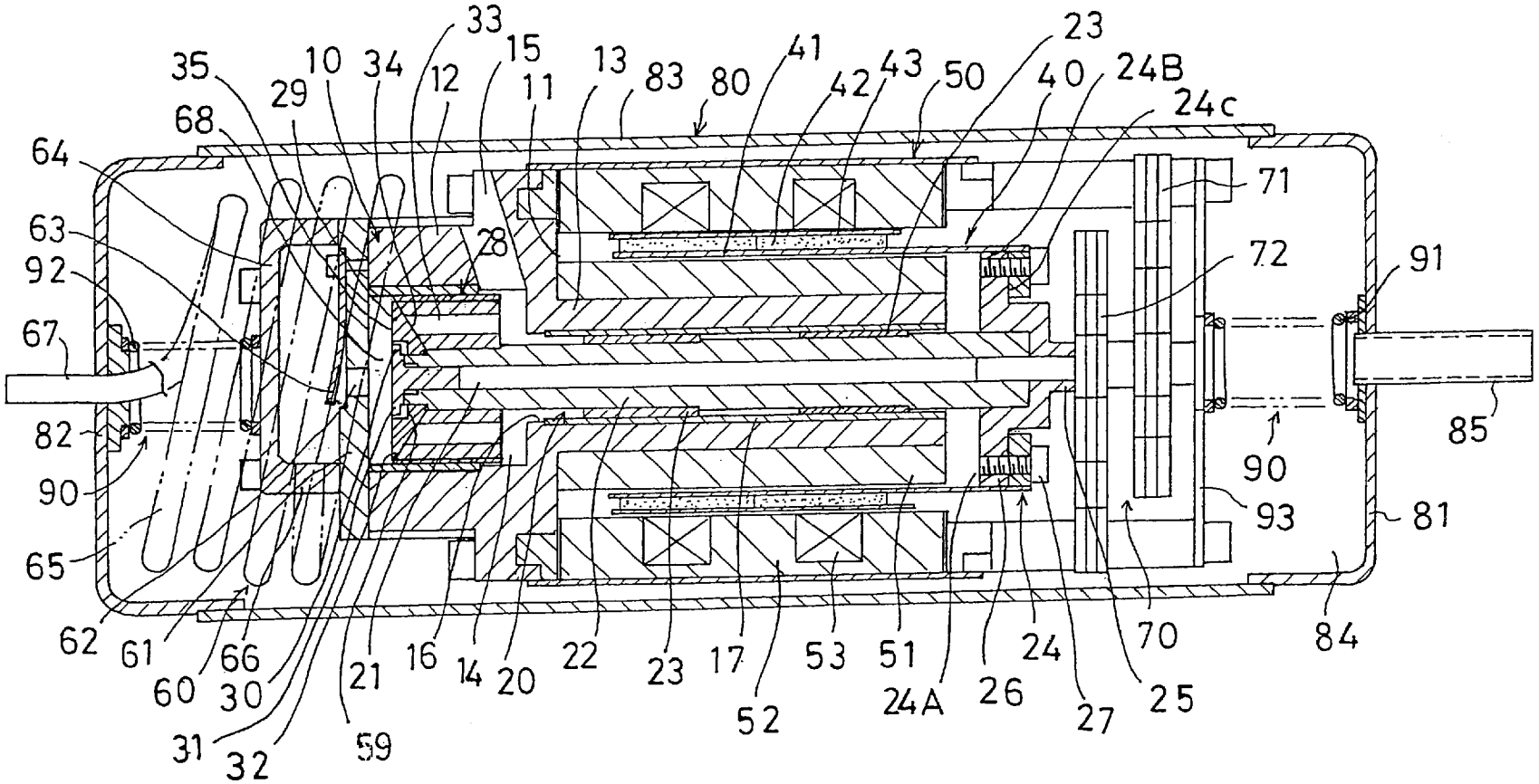
FIG. 1 is a sectional view showing the entire structure of a linear compressor according to an embodiment of the present invention.

An embodiment of a linear compressor of the present invention will be explained based on the drawings below. Referring to FIG. 1, the entire structure of the linear compressor of the invention will be explained first. The linear compressor broadly comprises a cylinder 10, a piston 20, a movable member 40 as well as stationary member 50 both constituting a linear motor, a discharge mechanism 60, a spring mechanism 70, a vessel 80, a supporting mechanism 90, and the like.

The cylinder 10 is integrally provided with a flange portion 11, a boss 12 extending leftward in the drawings (forward) from the flange portion 11, and a cylindrical member 13 for holding the piston 20. In the boss 12, a space 14 is formed which forms a compressing chamber in which a piston body 28 is disposed. A front end of the space 14 is opened. A suction port 15 provided at the flange portion 11 side is in communication with the space 14. A cylinder bore 16 formed in the cylindrical member 13 is in communication with the space 14, and a rear end of the cylindrical member 13 is opened. A thin ring body 17 made of metal material is fitted into the cylinder bore 16. In the present embodiment, the cylinder 10 is made of aluminum material, and the ring body 17 is provided for reducing the mechanical loss.

Figure 2:
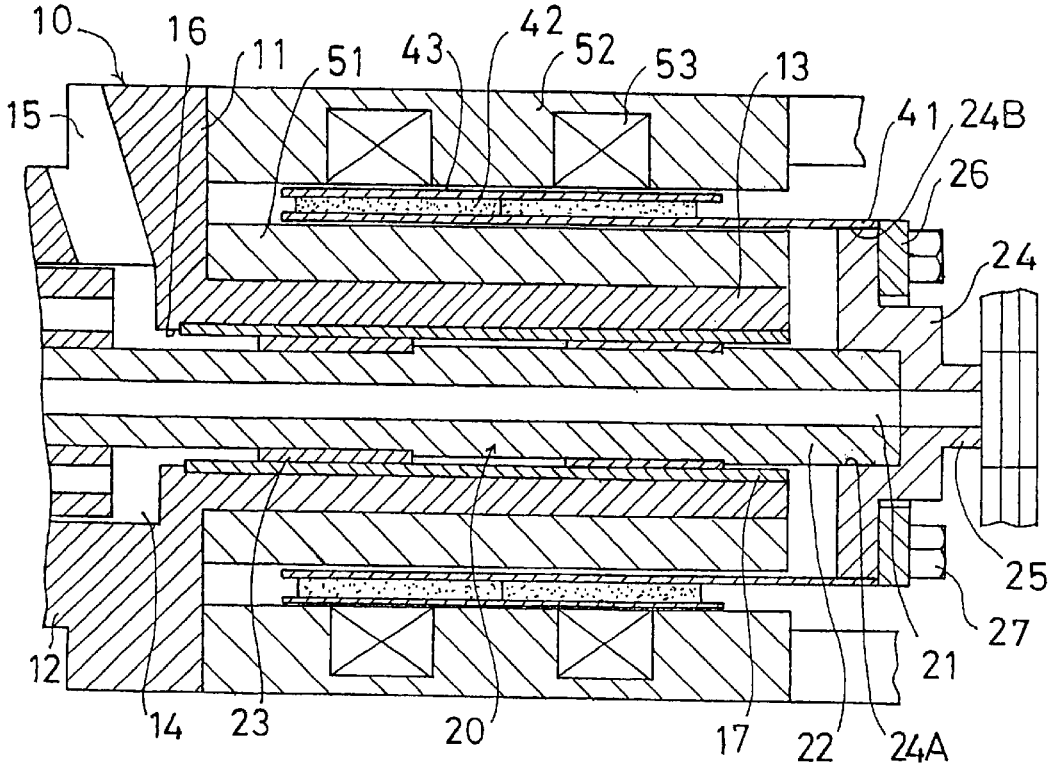
FIG. 2 is an enlarged sectional view of an essential portion of a linear motor of the linear compressor.
Figure 3:
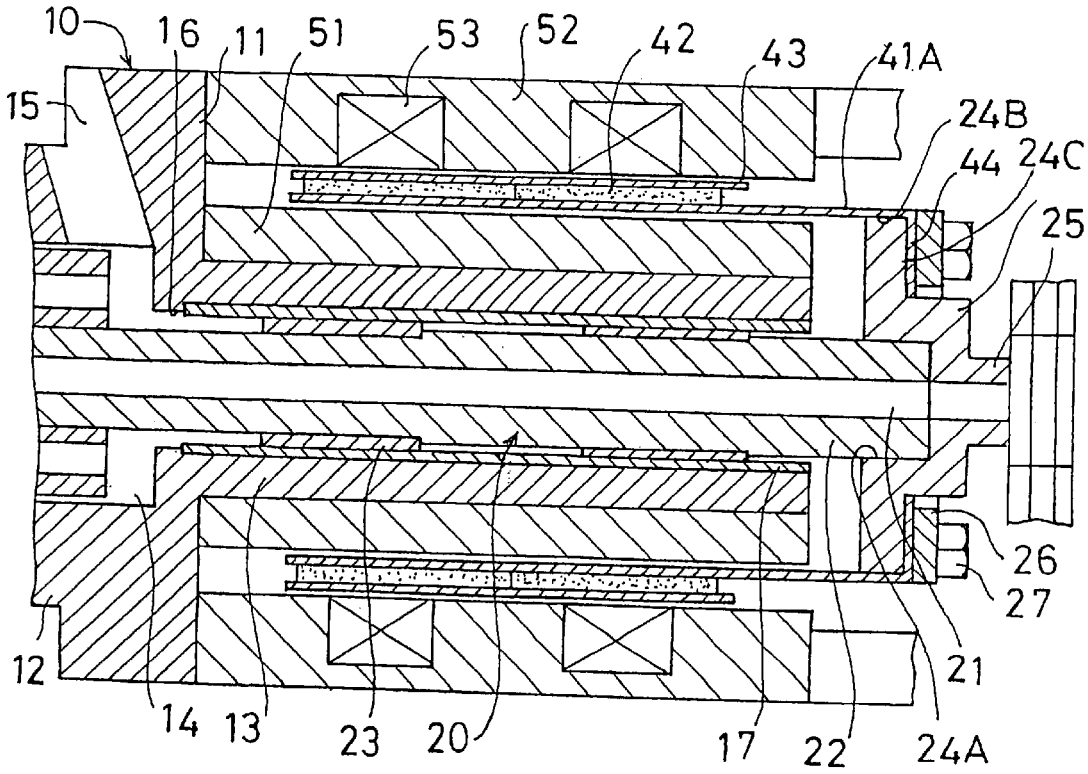
FIG. 3 is an enlarged sectional view of an essential portion of a linear motor of another embodiment of the invention.

As shown in FIGS. 1 to 3, the piston 20 comprises rod 22 forming an inner hole 21, and a piston body 28. In the present embodiment, the piston 20 is made of aluminum material. By making the piston 20 of aluminum material, its weight can be reduced, and stiffness of the spring mechanism 70 can be lowered, as will be explained later. It is difficult to make the piston 20 of aluminum material only in view of wear resistance. Therefore, in the present embodiment, the piston 20 comprises the rod 22 and a thin steel liner 23 fitted around the outer periphery of the piston body 28. Since the thin steel liner 23 is movably held by the ring body 17 at the cylinder 10 side, it is important to examine the chemistry between the liner 23 and the ring body 17 to reduce the moving resistance to the utmost, and to select material which can prevent wear between both the members. The piston 20 is provided at its rear end with a flange 24, and at its front end with the piston body 28. Since the piston 20 is light in weight as described above, the spring stiffness of the spring mechanism 70 may be low, stress generated when the piston 20, or the like, is operated is small, and the durability is enhanced. The flange 24 comprises a side surface 24B which centrally forms a hole 24A to which the piston 20 is fitted and which is concentric with the axis of the piston 20. The flange 24 also comprises an end surface 24C formed perpendicular to the axis of the piston 20 and adjacent to the side surface 24B, and a connecting shaft 25 which is connected to the spring mechanism 70. A ring-like pushing plate 26 which abuts against the end surface 24C is connected to the flange 24 through a bolt 27.

Figure 5:
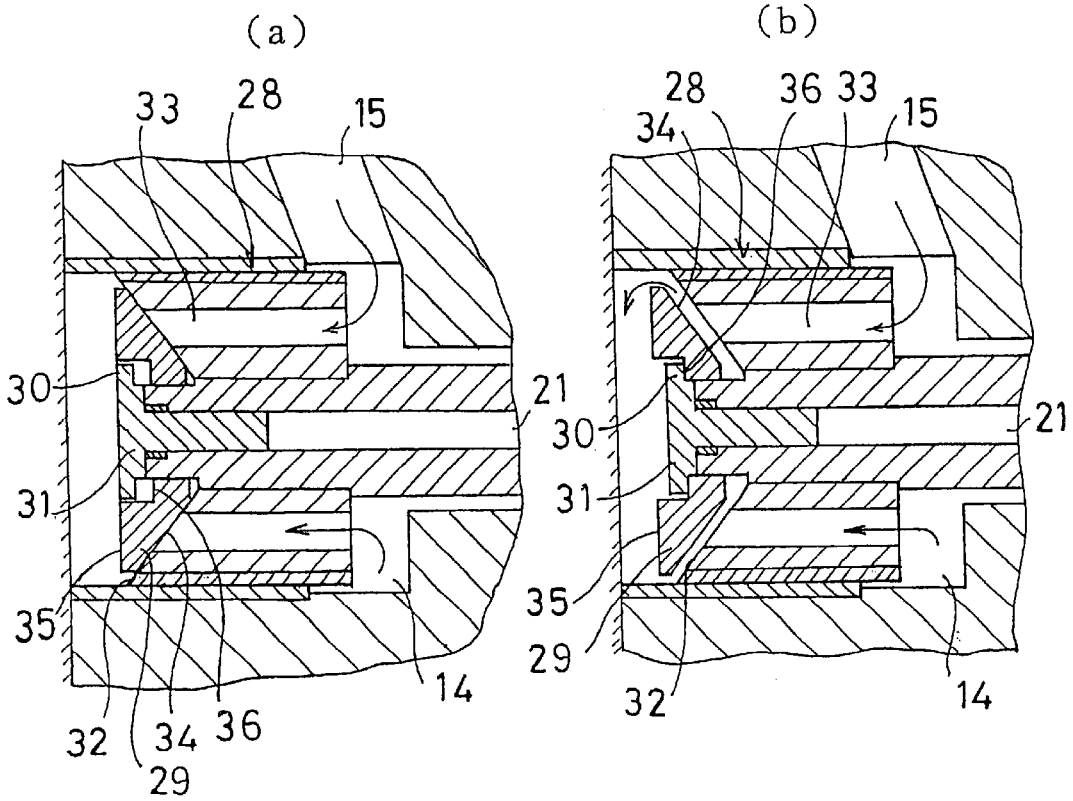
FIGS. 5(*a*) and 5(*b*) are enlarged sectional views of essential portions of a suction mechanism of an embodiment of the invention.

As shown in FIG. 5, the piston body 28 comprises an opening/closing valve 29 provided at the opening side of the front end of the piston 20, and a stopper member 31 for movably supporting the opening/closing valve 29 along the axial direction and for forming a stopper portion 30 which restrains the moving amount. A tapered surface 32 is formed at the opening side of the front end of the piston body 28. A plurality of through-holes 33 through which sucked refrigerant passes are formed, and the through-holes 33 are in communication with the suction port 15. A shaft portion of the stopper member 31 is fitted into the inner hole 21 of the piston 20 and the stopper member 31 is fixed to a tip end of the rod 22. The opening/closing valve 29 includes a tapered portion 34 which abuts against the tapered surface 32 of the piston body 28, and comprises a cone member formed at its front end with a flat surface 35, and the opening/closing valve 29 is movably supported at the tip end of the piston 20. The opening/closing valve 29 is formed with a step surface 36 which abuts against the stopper portion 30 through an appropriate distance. Because of the above-described structure, the opening/closing valve 29 can move along the axial direction of the piston 20 by the above-mentioned distance as shown in FIGS. 5(*a*) and (*b*), and when the piston 20 is moved in a direction for compressing the refrigerant, the tapered portion 34 of the opening/closing valve 29 abuts against the tapered surface 32 of the piston body 28 to close the through-hole 33.

In the present embodiment, although the rod 22, the piston body 28 and the flange 24 are separately formed as shown in FIG. 1, the rod 22 and the piston body 28, or the rod 22 and the flange 24 may be integrally formed.

The linear motor will be explained next. As described above, the linear motor comprises the movable member 40 and the stationary member 50. The movable member 40 comprises a cylindrical holding member 41, a permanent magnet 42 and a cylindrical body 43. The stationary member 50 comprises an inner yoke 51, an outer yoke 52 and a coil 53.

FIG. 2 is an enlarged sectional view of an essential portion for explaining the movable member 40 and the stationary member 50. All of the cylindrical holding member 41, the permanent magnet 42 and the cylindrical body 43 of the movable member 40 are cylindrical in shape, and are disposed concentrically with the piston 20. The cylindrical holding member 41 is thin, and is disposed in a state in which its rear end is in contact with the side surface 24B of the flange 24. The cylindrical holding member 41 is fitted to the flange 24 or fixed by fixing means which is not shown. With the above arrangement, the cylindrical holding member 41 is disposed concentrically with the piston 20.

The permanent magnet 42 is disposed such that it is in contact with the cylindrical holding member 41. The cylindrical body 43 is disposed such that it is in contact with the permanent magnet 42. In the present embodiment, the permanent magnet 42 is sandwiched between the cylindrical holding member 41 and the cylindrical body 43. With the above arrangement, the cylindrical holding member 41, the permanent magnet 42 and the cylindrical body 43 are disposed concentrically with the piston 20 with high precision.

As described above, the stationary member 50 comprises the inner yoke 51, the outer yoke 52 and the coil 53. The inner yoke 51 is cylindrical in shape, and in the present embodiment, the inner yoke 51 is in contact with the cylindrical member 13 of the cylinder 10, and is fixed to the flange portion 11. A fine gap is formed between the outer periphery of the inner yoke 51 and the cylindrical holding member 41. With the above arrangement, the inner yoke 51 is disposed concentrically with the cylinder 10 and the piston 20. The outer yoke 52 is also cylindrical in shape, and is disposed such that a fine gap is formed between the outer yoke 52 and the outer periphery of the cylindrical body 43. The outer yoke 52 is fixed to the flange portion 11 of the cylinder 10. With the above arrangement, the movable member 40 and the stationary member 50 are held concentrically with each other with high precision.

In the linear compressor of the present embodiment, the stationary member 50 and the movable member 40 constituting the linear motor are disposed around outer peripheries of the cylinder 10 and the piston 20, respectively, and the piston 20 and the linear motor are not juxtaposed in the moving direction. Therefore, the overall length of the piston 20 and the movable member 40 which become moving members can be shortened as compared with a case in which the piston 20 and the linear motor are juxtaposed in the moving direction, and even if the piston 20 is inclined slightly, the fine gap between the stationary member 50 and the movable member 40 is maintained stably. Further, the coil 53 is provided in the outer yoke 52, and is disposed outside the movable member 40. Therefore, it is unnecessary to draw into the vessel 80 a wire for passing a current to the coil 53. Furthermore, since the inner yoke 51 is fixed to the cylinder 10, and is not fixed to the movable member 40, the movable member 40 can be reduced in weight.

As described above, the movable member 40 and the stationary member 50 are held concentrically with each other with high precision, the movable member 40 is reduced in weight and therefore, the moving motion can be carried out smoothly. Further, since the permanent magnet 42 is sandwiched and fixed between the cylindrical holding member 41 and the cylindrical body 43, an adhesive or a setscrew is not used at all. Therefore, the mounting operation is facilitated, and the permanent magnet 42 can be held for a long term with high precision.

FIG. 3 shows another embodiment of the cylindrical holding member. This cylindrical holding member 41A comprises a flange surface 44 which is integrally formed on the rear end of the cylindrical holding member 41 shown in FIG. 2. The flange surface 44 is disposed in a direction perpendicular to the axis of the piston 20. This cylindrical holding member 41A is held by the side surface 24B and the end surface 24C of the flange 24. That is, like the cylindrical holding member 41, the cylindrical holding member 41A is fitted to the side surface 24B, the flange surface 44 abuts against the end surface 24C, the pushing plate abuts against the flange surface 44, the bolt 27 is fastened, thereby holding the cylindrical holding member 41A strongly by the flange 24 with high precision. In FIG. 3, other constituent elements are the same as those shown in FIG. 2.

Figure 4:
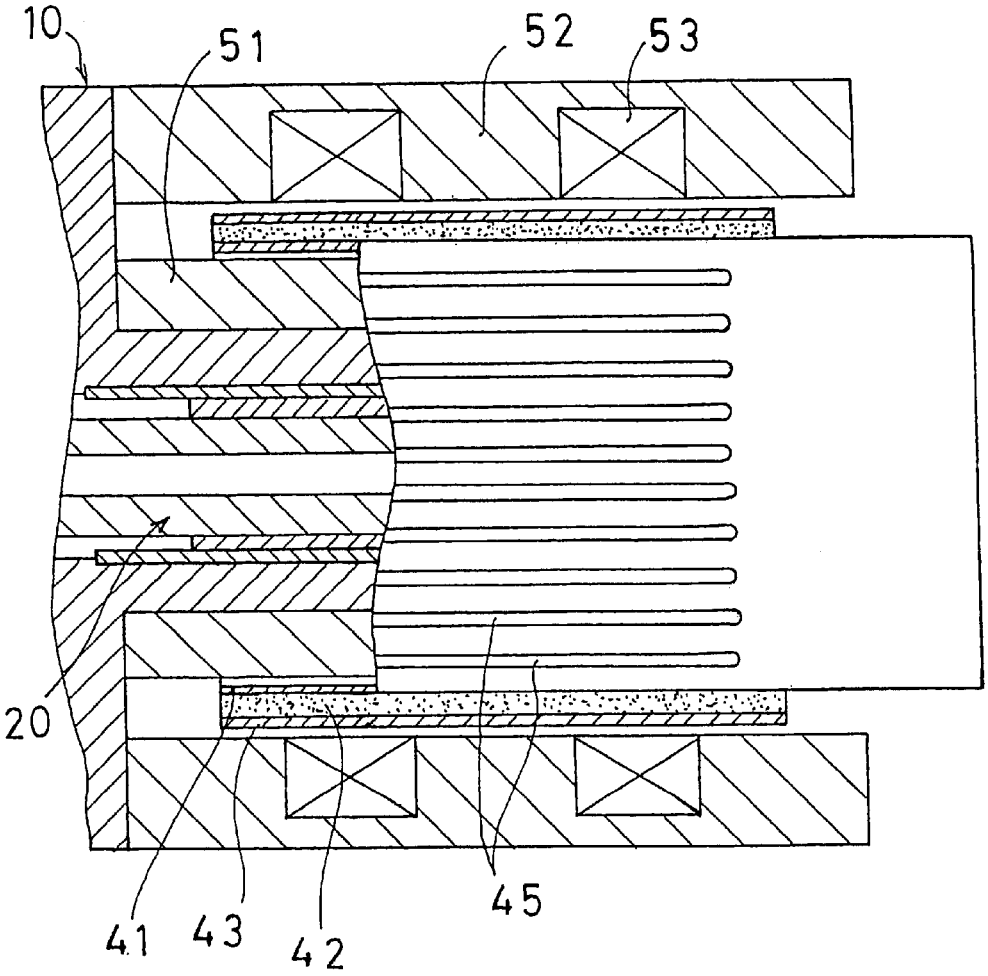
FIG. 4 is an enlarged sectional view of an essential portion of a cylinder body of a movable portion of the linear motor of an embodiment of the invention.

FIG. 4 shows detailed structure of the cylindrical holding member 41. The cylindrical holding member 41 is a thin cylindrical body, and the permanent magnet 42 is provided around the cylindrical holding member 41. As shown in FIG. 4, the cylindrical holding member 41 is formed with a large number of slits 45 along the axial direction of the piston 20. The cylindrical holding member 41 can prevent eddy current from being generated by these slits 45. It is also effective that the same slits are formed in the cylindrical body 43.

Figure 6:
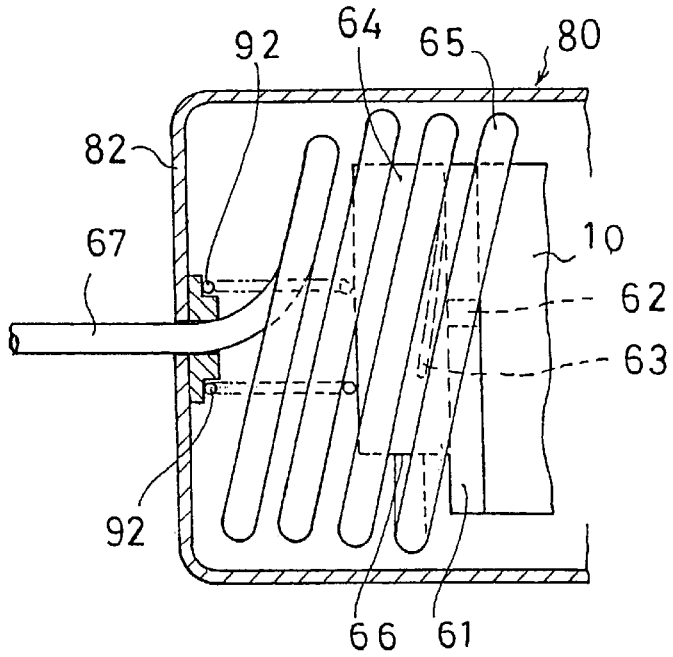
FIG. 6 is an enlarged sectional view of an essential portion of a discharge mechanism of an embodiment of the invention.

Referring to FIG. 6, the discharge mechanism 60 will be explained next. A discharge valve supporting body 61 is fixed to a front end of the cylinder 10, and a discharge hole 62 is formed in its central portion. A discharge valve 63 is provided in the discharge hole 62. A muffler 64 is fixed to the valve supporting body 61. A base end of a coiled discharge pipe 65 is connected to a discharge port 66 of the muffler 64, and a front end of the coiled discharge pipe 65 is connected to a discharge pipe 67. As shown in FIG. 6, the coiled discharge pipe 65 comprises a pipe which is coiled, and portions thereof are wound around an outer peripheral space of the cylinder 10 and the muffler 64.

Next, the spring mechanism 70, the vessel 80 and the supporting mechanism 90 will be explained based on FIG. 1.

The spring mechanism 70 comprises flat spring plates 71 and 72 disposed at rear sides. As shown in FIG. 1, the spring plates 71 and 72 are disposed at rear sides of the cylinder 10 and the piston 20 such as to be astride the cylinder 10 and the piston 20.

The vessel 80 is a cylindrical container comprising a rear end plate 81, a front end plate 82 and a cylindrical barrel body 83 fixed between the rear end plate 81 and the front end plate 82, and a space 84 is formed inside the vessel 80. Constituent elements of the linear compressor are accommodated in the space 84. The rear end plate 81 is provided with a suction pipe 85, and the front end plate 82 is provided with a discharge pipe 67.

The supporting mechanism 90 comprises a rear coil spring 91 and a front coil spring 92. The rear coil spring 91 is disposed between an astride plate 93 and the rear end plate 81 of the vessel 80, and the front coil spring 92 is disposed between the muffler 64 and the front end plate 82 of the vessel 80. The rear coil spring 91 and the front coil spring 92 are for preventing vibrations transmitted to the cylinder 10 from being transmitted to the vessel 80.

The operation of the linear compressor of the present embodiment will be explained.

First, if the coil 53 of the stationary member 50 is energized, a thrust force proportional to current is generated Is between the coil 53 and the permanent magnet 42 of the movable member 40 by Fleming's left-hand rule. By this thrust force, a retreating driving force along the axial direction is applied to the movable member 40. Since the cylindrical holding members 41, 41A of the movable member 40 are fixedly held by the flange 24 and the flange 24 is connected to the piston 20, the piston 20 is retreated. Since the piston 20 is movably supported by the cylinder 10, the piston 20 is retreated along its axial direction.

On the other hand, since the opening/closing valve 29 is freely supported by the piston body 28, a gap is generated between the opening/closing valve 29 and the piston body 28 by the retreat of the piston 20.

Here, current is applied to the coil 53 in a sine wave, a forward thrust force and a backward thrust force are alternately generated in the linear motor. By the alternately generated forward thrust force and backward thrust force, the piston 20 reciprocates.

The refrigerant is introduced into the vessel 80 from the suction pipe 85. The refrigerant introduced into the vessel 80 is introduced into the space 14 of the cylinder 10 from the suction port 15 of the cylinder 10. The refrigerant is introduced into a suction compressing chamber 68 from a gap generated between the tapered portion 34 of the opening/closing valve 29 and the tapered surface 32 of the piston body 28. The refrigerant in the suction compressing chamber 68 is compressed by the advancing motion of the piston 20. The compressed refrigerant opens the discharge valve 63, and enters into the muffler 64 through the discharge hole 62 of the discharge valve supporting body 61 where the refrigerant is dispersed and noise thereof is reduced, and the refrigerant is introduced from the discharge port 66 into the coiled discharge pipe 65, and is discharged out from the discharge pipe 67.

The vibration of the cylinder 10 generated in association with the reciprocating motion of the piston 20 is suppressed by the rear and front coil springs 91 and 92.

As explained above, according to the present invention, the linear motor is disposed around the outer periphery of the piston 20, and the piston 20 and the linear motor are not juxtaposed in the moving direction. Therefore, the overall length of the moving portion comprising the movable member 40 and the piston 20 is shortened as compared with a case in which the piston 20 and the linear motor are juxtaposed in the moving direction. Therefore, even if the piston 20 is inclined slightly, little influence is exerted on the inclination of the movable member 40. Further, since the movable member 40 is held concentrically with the piston 20, the movable member 40 can smoothly move together with the movement of the piston 20 while keeping the concentric relation therewith. On the other hand, stationary member 50 is fixedly held at the cylinder 10 side, the fine gap between the movable member 40 and the stationary member 50 is little varied, and the piston 20 can move smoothly and efficiently.

Further, since the permanent magnet 42 of the movable member 40 is sandwiched and fixed between the cylindrical holding members 41, 41A and the cylindrical body 43 without using the adhesive or screw, the permanent magnet 42 can easily be mounted, and is always maintained stably. Further, by providing the slits 45 in the cylindrical holding member 42 and the cylindrical body 43, the generation of eddy current is reduced, and the performance is prevented from being lowered.

In the above description, although the linear compressor is as shown in FIG. 1, detailed structure thereof should not be limited to the illustrated structure.

According to the present invention, the mounting precision of the piston of the movable member of the linear motor can be enhanced, and the gap between the stationary member and the movable member can always be maintained stably. Therefore, reciprocating motions of the piston and the suction mechanism are smoothly and stably be carried out, and the compression efficiency can be enhanced. Further, the permanent magnet can easily be mounted to the movable member with high precision, and the mounting operation is facilitated.

What is claimed is:

1. A linear compressor, comprising: a cylinder having a longitudinal axis supported in a vessel by a supporting mechanism; a piston having a longitudinal axis concentric with said cylinder axis and movably supported along an axial direction of said cylinder; and a linear motor for forming a magnetic path by a movable member containing a permanent magnet, said movable member being radially spaced from said piston and being fixed to said piston for movement therewith, and a stationary member fixed to said cylinder to generate a thrust force; said stationary and movable members of said linear motor being disposed around an outer periphery of said piston; a flange member formed separate from said piston but fixedly attached thereto, said flange member including a radially extending flange having a side surface formed concentrically with said flange member and being disposed radially outwardly spaced from the axis of said flange member, and said movable member including a cylindrical holding member, said holding member having a cylindrical interior surface disposed in contact with, and fixed to, said side surface of said flange.

2. A linear compressor, comprising: a cylinder having a longitudinal axis supported in a vessel by a supporting mechanism; a piston having a longitudinal axis concentric with said cylinder axis and movably supported along an axial direction of said cylinder; and a linear motor for forming a magnetic path by a movable member containing a permanent magnet, said movable member being radially spaced from said piston and being fixed to said piston for movement therewith, and a stationary member fixed to said cylinder to generate a thrust force; said stationary and moveable members of said linear motor being disposed around an outer periphery of said piston; a flange member formed separate from said piston but fixedly attached thereto, said flange member including a radially extending flange having a side surface formed concentrically with said flange member and being disposed radially outwardly spaced from the axis of said flange member, said flange having an end surface formed perpendicular to said side surface thereof, and said movable member including a cylindrical holding member having a radially inturned portion, wherein said cylindrical holding member is fixed to said flange side surface and said inturned portion is fixed to said flange end surface.

3. A linear compressor according to claim 1 or claim 2, wherein said cylinder is provided with a flange portion, said flange portion is formed concentrically with said axis of said cylinder, said stationary member constituting said linear motor and being formed cylindrically, and said stationary member is fixed to said flange portion.

4. A linear compressor according to claim 3, wherein said movable member comprises a permanent magnet, and said stationary member comprises an outer yoke and a coil.

5. A linear compressor, comprising: a cylinder supported in a vessel by a supporting mechanism; a piston concentric with said cylinder and movably supported along an axial direction of said cylinder, and a linear motor for forming a magnetic path by a permanent magnet fixed to said piston and a coil fixed to said cylinder to generate a thrust force; said linear motor being disposed around an outer periphery of said piston, wherein said permanent magnet is sandwiched and fixed between a cylindrical holding member fixed to said piston and a cylindrical body concentric with said cylindrical holding member.

6. A linear compressor according to claim 5, wherein said permanent magnet is provided around an outer periphery of said cylindrical holding member, and said cylindrical body is provided around an outer periphery of said permanent magnet.

7. A linear compressor according to claim 5, wherein said cylindrical holding member or said cylindrical body is made of metal material, and said cylindrical holding member or said cylindrical body is provided with a slit.

8. A linear compressor, comprising: a cylinder supported in a vessel by a supporting mechanism; a piston concentric with said cylinder and movably supported along an axial direction of said cylinder, and a linear motor for forming a magnetic path by a movable member fixed to said piston and a stationary member fixed to said cylinder to generate a thrust force; said linear motor being disposed around an outer periphery of said piston, wherein said piston is provided with a flange having a side surface formed concentrically with an axis of said piston, said movable member is held by a cylindrical holding member, and said cylindrical holding member is fixed such that said cylindrical holding member is in contact with said side surface of said flange, wherein an outer peripheral surface of said cylinder is formed concentrically with an axis of said cylinder, said stationary member constituting said linear motor is formed cylindrically, and said stationary member is held by said cylinder such that said stationary member is in contact with said outer peripheral surface.

9. A linear compressor, comprising: a cylinder supported in a vessel by a supporting mechanism; a piston concentric with said cylinder and movably supported along an axial direction of said cylinder, and a linear motor for forming a magnetic path by a movable member fixed to said piston and a stationary member fixed to said cylinder to generate a thrust force; said linear motor being disposed around an outer periphery of said piston, wherein said piston is provided with a flange which has a side surface formed concentrically with an axis of said piston and an end surface formed perpendicular to said axis of said piston, said movable member is held by a cylindrical holding member, and said cylindrical holding member is fixed such that said cylindrical holding member is in contact with said side surface and said end surface of said flange, wherein an outer peripheral surface of said cylinder is formed concentrically with an axis of said cylinder, said stationary member constituting said linear motor is formed cylindrically, and said stationary member is held by said cylinder such that said stationary member is in contact with said outer peripheral surface.

10. A linear compressor according to either one of claim 8 or claim 9, wherein said movable member is a permanent magnet, and said stationary member in an inner yoke.

* * * * *